United States Patent [19]

Scales

[11] Patent Number: 4,875,803

[45] Date of Patent: Oct. 24, 1989

[54] BLOCK-FORMED REVETMENT SYSTEM FOR CONTROLLING SOIL EROSION

[76] Inventor: Michael J. Scales, 4905 Windwood Dr., Doraville, Ga. 30360

[21] Appl. No.: 220,078

[22] Filed: Jul. 18, 1988

[51] Int. Cl.[4] ..... E02B 3/12

[52] U.S. Cl. ..... 405/16; 405/19; 404/41; 52/603; 52/608

[58] Field of Search ..... 405/15, 16, 17, 20, 405/21, 23, 25; 404/34, 40, 41; 52/603, 608

[56] References Cited

U.S. PATENT DOCUMENTS

| | | | |
|---|---|---|---|
| 1,244,008 | 9/1917 | Wheeler | 404/34 |
| 3,875,750 | 4/1975 | Campbell | 405/33 |
| 3,903,702 | 9/1975 | Appleton | 405/20 |
| 4,465,398 | 8/1984 | Knudsen | 405/15 X |
| 4,564,311 | 1/1986 | Scales | 405/20 |

FOREIGN PATENT DOCUMENTS

| | | | |
|---|---|---|---|
| 968989 | 5/1950 | France | 405/16 |
| 241403 | 10/1925 | United Kingdom | 404/41 |

*Primary Examiner*—Dennis L. Taylor
*Assistant Examiner*—Arlen L. Olsen
*Attorney, Agent, or Firm*—Needle & Rosenberg

[57] ABSTRACT

A flexible revetment mat used to control soil erosion comprised of a plurality of blocks each having a hexagonally shaped grid held firmly together by tongue and cavity coupling means. The tongues and cavities are shaped to allow limited movement of each tongue within its associated cavity. The blocks may be placed into position with or without connecting cables. The shape of the blocks and location of through tunnels allows the use of cables. The blocks are preferably hexangular to resist horizontal hydraulic forces at various directions.

36 Claims, 10 Drawing Sheets

BLOCK-FORMED REVETMENT SYSTEM FOR CONTROLLING SOIL EROSION

BACKGROUND OF THE INVENTION

This invention relates to erosion control systems, and more particularly to an erosion control system which utilizes a plurality of hexagonal blocks having tongue and cavity coupling means to form an entire revetment comprised of hand-placed blocks and/or preassembled machine-placed interlocking hexangular block mats.

The erosion of natural and artificial channels, beaches, and other points where water interfaces with soil is a frequently encountered and much studied problem. Erosion can be the result of abrasion, which is the removal of material from the surface of a bank. The primary cause of abrasion is the movement of water along the soil/water interface, with contributing factors being high velocities, currents, waves, long-eddies and boat wash.

Various revetment systems have been used in attempts at preventing, or at least slowing, erosion. Randomly sized concrete chunks, or "riprap", have been placed along riverbanks and beaches in attempts to slow erosion. Too often, though, the chunks would be too large and some erosion would still occur. Similarly, attempts at paving have been futile due to the destructive effects of hydrostatic pore pressure.

Recently, revetment constructions utilizing interconnected blocks have become known. These constructions typically involve placing blocks of various shapes into a mat which in turn, is placed along the riverbank or beach. These mats make intimate contact with the underlying soil during settlement and prevent realignment of the slope by wave and current action. However, because such constructions have ignored one or more basic considerations, there has yet to exist a truly effective means of preventing hydrodynamic failures due to waves and currents.

One overlooked consideration involves the "uplifting"of entire revetments due to hydrostatic pore pressure. When water passes between the bottom of a revetment, or an individual block, and the earth, hydraulic action takes place. This, for example, results when waves of passing vessels and natural variable frequency and wave heights cause turbulence, thereby affecting water pressures under the revetment and in the subsoil. When the uplift pressure forces become greater than the sum of the weight of the block and its friction forces, a loss of stability occurs, and one or more blocks can be lifted from the revetment.

A second overlooked consideration is that the interconnected blocks must be permitted to shift within reasonable bounds within the mat so as to avoid any individual block taking the entire destructive force outlined above, and yet be restrained so as not to become dislodged. If firmly restricted, the interconnecting members of the block are apt to break off or sheer when the blocks move during hydraulic action, which in turn can result in the dislocation of the block and the eventual loss of an entire revetment. This is especially important when concrete, which is low in tensile strength, is used to produce the blocks.

Another overlooked consideration relates to the means used to interlock the blocks. Reinforcing or connecting rods and cables made of material subject to corrosion, such as steel, are traditionally used because unlike plastic, such materials best withstand attempted vandalism and do not break down upon exposure to sunlight. However, corrosion of such cables, when surrounded in concrete, causes the concrete to expand, which in turn results in spalling. Once spalling of the concrete takes place, the blocks are apt to crack or disintegrate and the entire revetment can be lost. Attempts at replacing such cables using blocks having interconnecting members have been made, but all have failed. Such interconnections have involved either solely horizontal locking members or have failed to allow the movement of members outlined above, or both.

Another important, yet unmet, consideration is cost effectiveness. Any efficient erosion control system must have low production and application costs. To keep costs low, the blocks must be of such design that they can be quickly assembled into a mat at a desired location in a systematic fashion without auxiliary components and by relatively unskilled labor.

There exists a need, therefore, for a block-formed revetment mat which is sufficiently stable so that no part can be displaced, sufficiently flexible so that the mat can bend to a limited extent without losing mutual connection between the blocks, sufficiently durable so as not to break apart or disintegrate, and economical in that it can be manufactured and applied quickly and at low cost.

SUMMARY

The above considerations are embodied in the present invention, which is directed to a hand-placed block-formed revetment or a mat for controlling soil erosion.

Each block has, as its main body, a hexagonally shaped grid and connecting means extending from the grid. Each sidewall of the grid is comprised of two vertical planar faces; a lower vertical face and an upper vertical face which slopes inwardly from the lower face to the top portion of the grid. Each sidewall has, on its lower vertical face, either a tongue or a cavity capable of coupling with such tongue on its lower vertical face. The shape of each tongue and cavity is such as to allow the tongue some movement within the cavity while preventing total horizontal or vertical dislocation. This encourages a small amount of controlled movement among the blocks and prevents breaking off of tongues during such movement. The bottom of each tongue is co-planar with the bottom of the grid to reduce space between the block and the subsoil, thereby reducing hydraulic lifting action. When horizontal or vertical movement occurs no single vertical face or tongue and cavity takes the full impact. Rather, the impact is distributed to all vertical walls and tongues.

According to one embodiment of the invention, three types of blocks are used, each having a hexagonal grid. An inner edge block type has a tongue on each of two adjacent lower vertical grid faces, and a cavity on each remaining vertical grid face. An outer edge block type has a cavity on each of two adjacent lower faces, and a tongue on each of the four remaining faces. An interior block type has a tongue on each of three adjacent lower faces, and a cavity on each of the remaining three adjacent lower faces. Optionally, a fourth opened block having a pair of adjacent open grooves in place of cavities may be used as end blocks. These end blocks enable a cable to pass through a mat without exposure when double cabled mats, as described more fully below, are used.

Each block may also have a plurality of holes extending from the top surface through the block to bottom of the grid. These holes aid in reducing hydrostatic pressure, create a high flow resistance, and allow vegetation to grow through the blocks so as to further stabilize the mat comprised of a plurality of the blocks. Furthermore, the holes produce eddy currents as the water traverses over the block, and thereby increase flow resistance.

Each block may have a through tunnel at a point approximately one inch from its bottom and traveling through at least one tongue and ending at a cavity. The uniform location of the tunnel allows grids of different heights, and hence, different weights, to be interconnected as needed. Various types of steel cables, rods, or high tensile plastic or other non-corrodable material may be passed through the tunnels of interconnected blocks. This allows a mat to be pre-assembled on land (which is economically more efficient than on-site assembly in water) and placed as a unit into final position in and along the water. The parallel location of the interconnections results in a mat with a catenary curve conducive to lifting. Without such a catenary curve, the blocks would crack upon being lifted. The cable or rods may remain in the positioned mat to provide greater stability if desired. Because each cable travels through the interconnected tongues and cavities, it is not exposed as it passes between blocks. This prevents vandalism and disintegration of plastic cables due to sunlight. Also, since the blocks are mechanically interconnected, fewer cables are needed as compared to mats traditionally used.

The assembly of the mat is accomplished by placement of the cavity of one block over a tongue of another. Additional couplings are made until a mat of juxtaposed blocks is formed. If assembly is to be done without cables and at the point of final position, such as within the water, only the interior type blocks need be used. If assembly is off-site, a row of inner edge blocks is connected to one edge of the mat so that a cavity appears on each exposed vertical wall of an inner mat edge, and a row of outer edge blocks is connected at the opposite edge of the mat so that a tongue appears on each exposed vertical wall of an outer mat edge. Upon placing the mats into final position, the tongued outer edge of a first mat can be interconnected with the cavitied inner edge of a second mat. Additional mats can be similarly connected to produce a revetment of any desired length. Likewise, an upper mat edge having a series of exposed cavities is formed at one end of the mat, and a lower mat edge having a series of exposed connecting tongues is formed at the opposite end. The tongued lower mat edge of a first mat can be interconnected with the cavitied upper edge of a second mat to produce a revetment of any desired width.

The invention, therefore, is useful in preventing washing away of a shoreline, as well as in a desert, along a highway, or other instances where erosion is a problem.

It is, therefore, an object of this invention to provide a block which will couple with other similar blocks without separate or auxiliary interconnecting means to form a revetment capable of controlling erosion of soil.

It is a further object of this invention to provide a block which, when coupled with other blocks, allows a limited amount of movement of both the blocks themselves and their connecting tongues.

It is a still further object of this invention to provide a block which, when coupled with other blocks, forms a mat which allows minimum space between its bottom surface and the subsoil.

It is another object of this invention to provide a block and revetment mat which reduces the effects of hydrodynamic pressure.

It is yet another object of this invention to provide a block and revetment mat through which vegetation can grow.

It is still another object of this invention to provide a block and revetment mat which allows a cable or rod or tubing to be placed through hand placed blocks to provide increased resistance to hydraulic uplift.

It is yet a further object of this invention to provide a block which, when coupled with other blocks, eliminates the dislocation of connecting means by vertical or horizontal force.

It is still another object of this invention to provide a block which, when coupled with other blocks, has a catenary curve when lifted.

It is still another object of this invention to provide a block which, when coupled with other blocks, minimizes exposure of any connecting cable passing between the blocks.

It is still another object of this invention to provide a block of uniform design which can be assembled into a mat quickly and by minimally skilled labor.

It is yet still another object of this invention to provide a revetment mat capable of being preassembled and easily connected to a second preassembled mat to form an assembly of any length or width.

It is also a further object of this invention to provide a revetment mat which is sufficiently flexible so as to accommodate the contours of the site upon which it is installed.

These and other objects and advantages will appear from the following description with reference to the drawings.

FIG. **6*a*** is a bottom view of an opened block according to the present invention.

Figure 7:
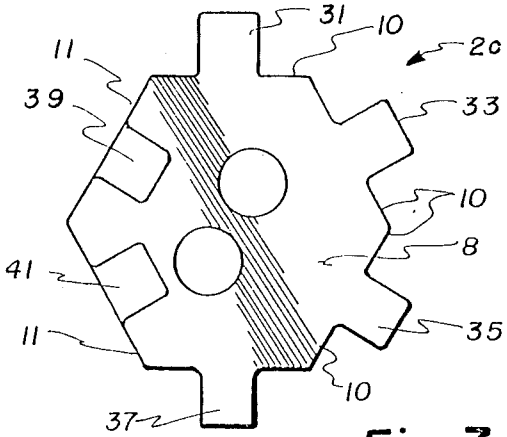

FIG. 7 is a bottom view of an outer edge block according to the present invention.

Figure 8:
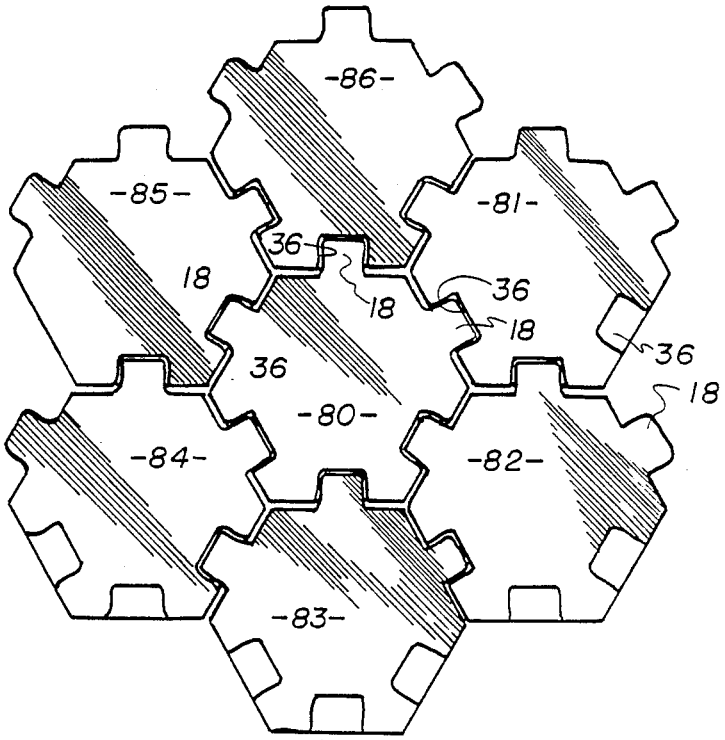

FIG. 8 illustrates a block being held in place by adjacent blocks.

Figure 9:
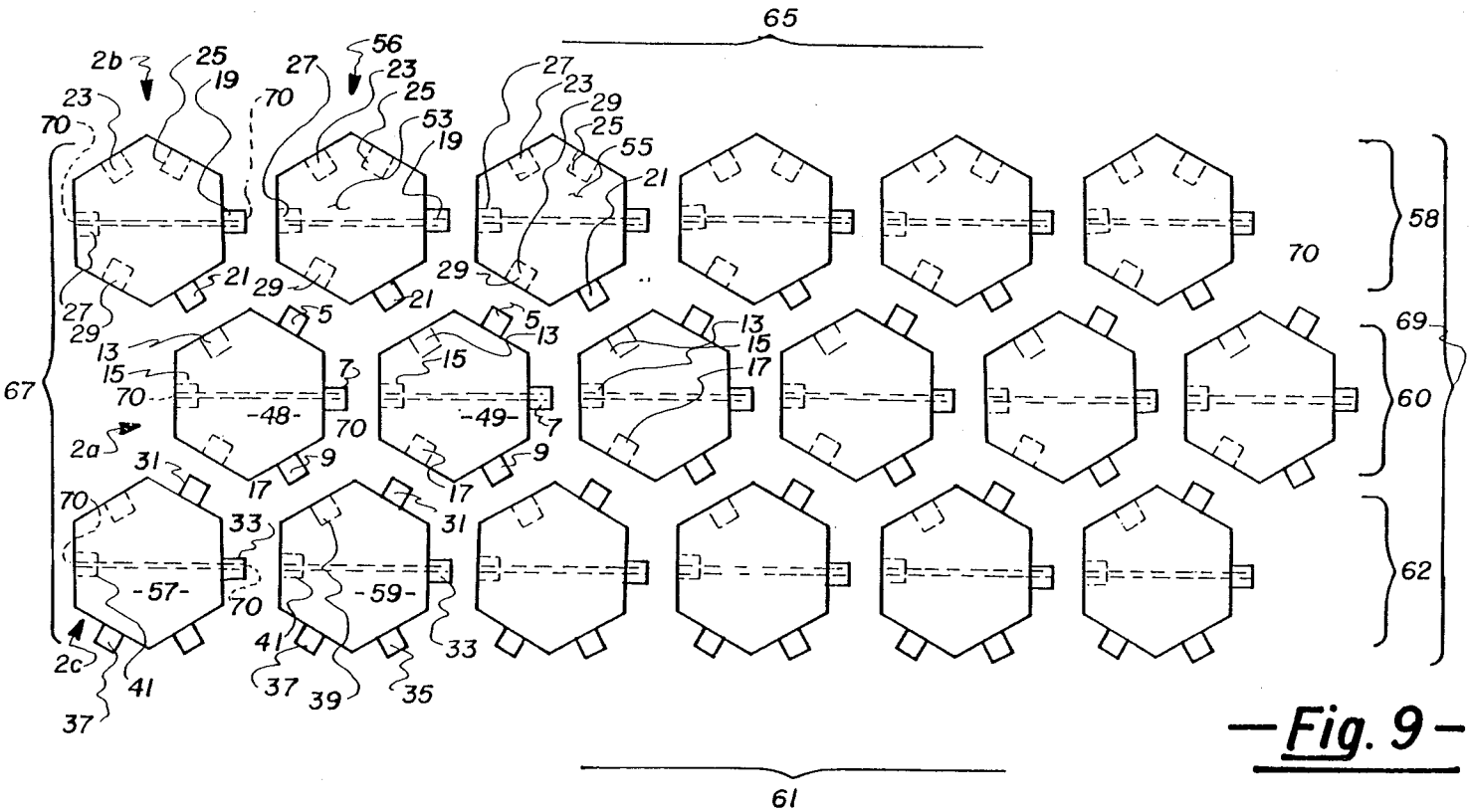

FIG. 9 is an exploded view of a revetment mat according to the present invention.

Figure 10:
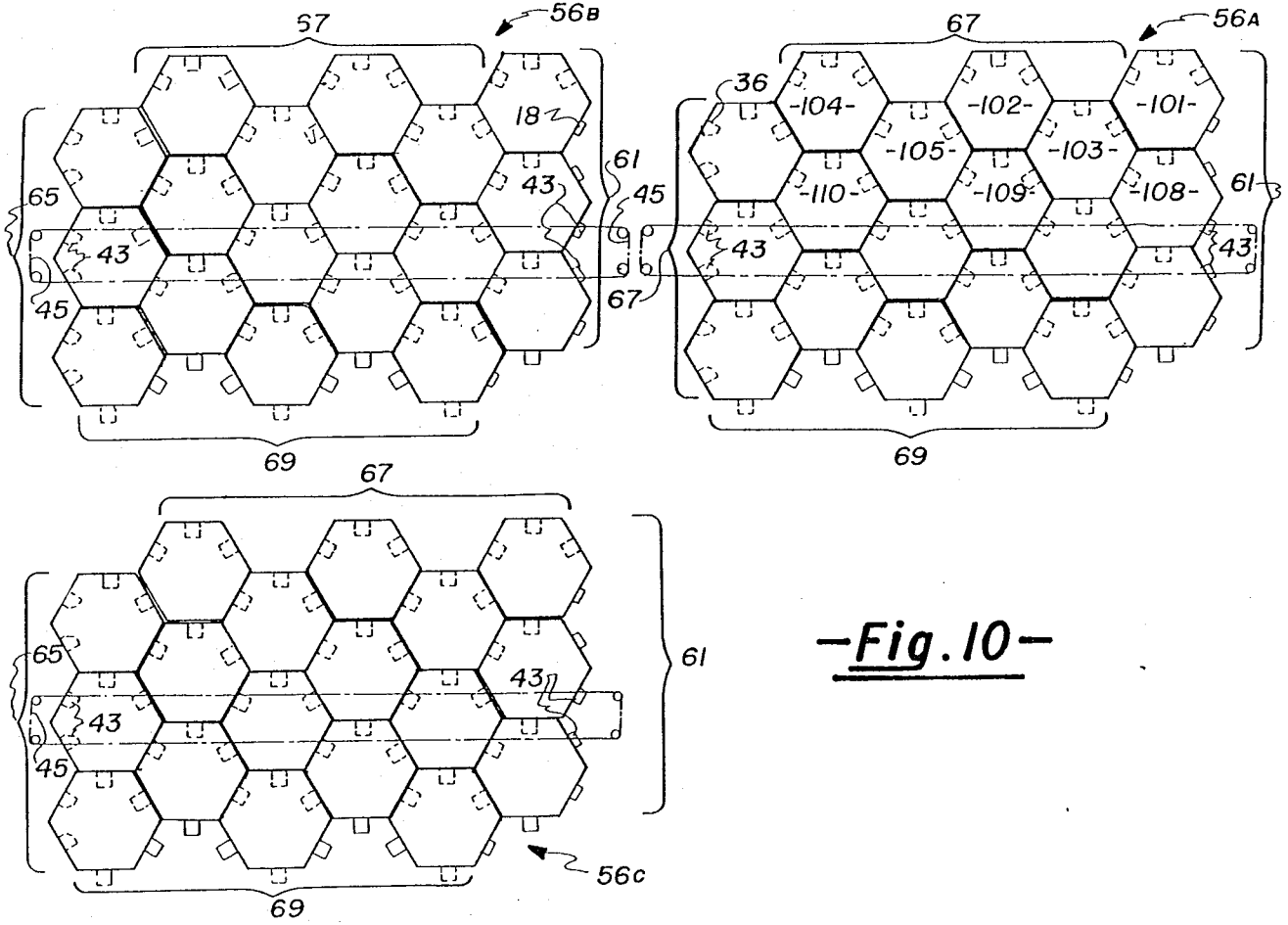

FIG. 10 is an exploded view of a revetment comprised of three revetment mats according to the present invention.

Figure 11:
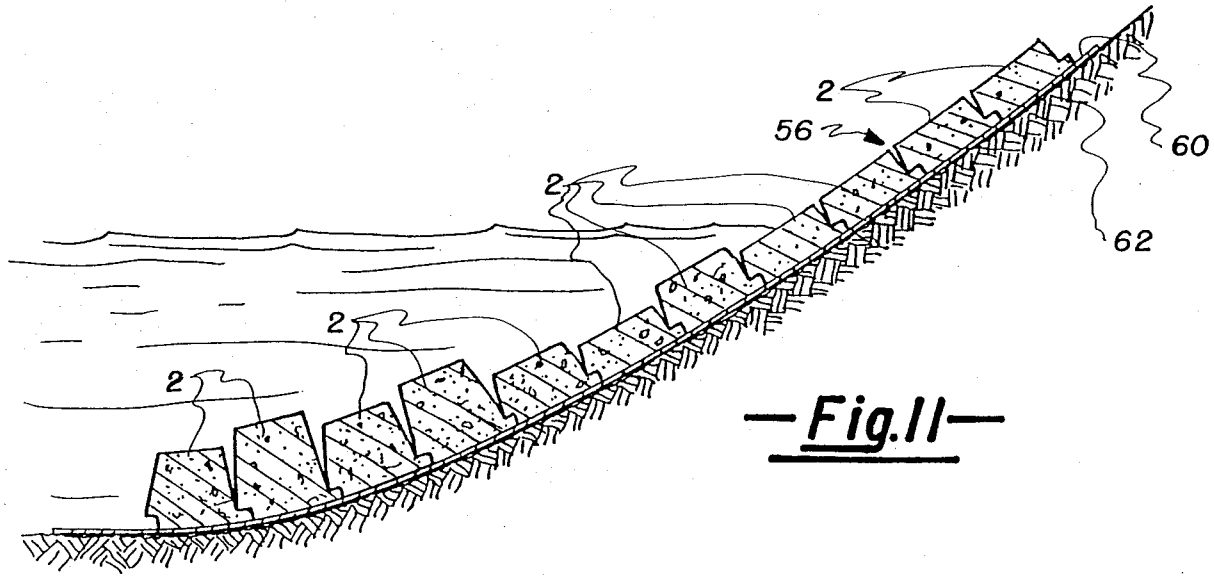

FIG. 11 is a cross-sectional view of a revetment according to the present invention having varying sized blocks positioned along a shoreline.

Figure 12:
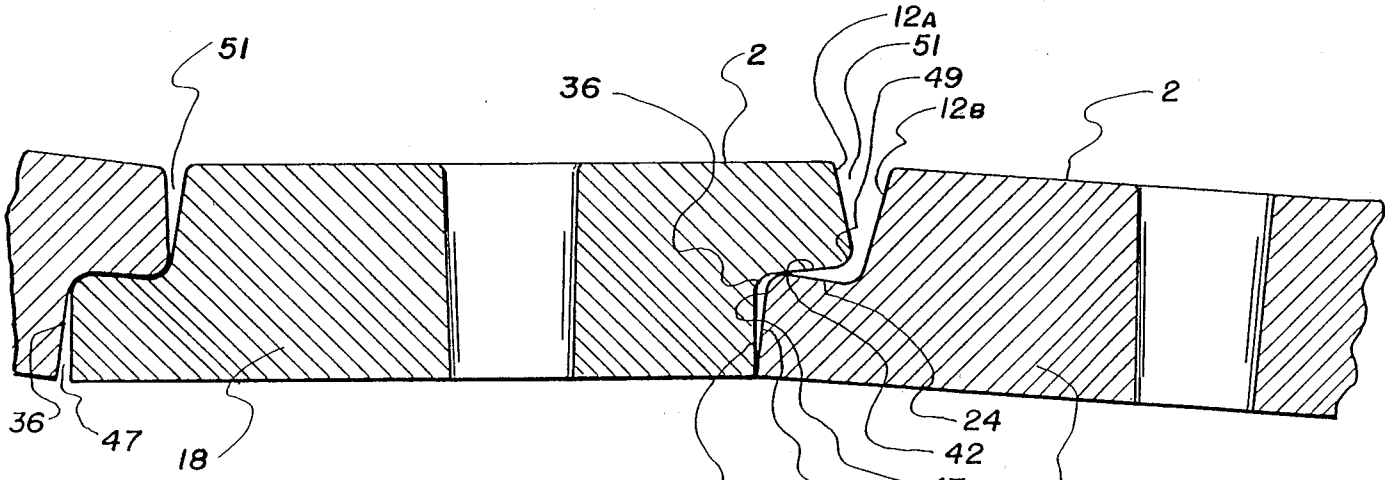

FIG. 12 is a cross-sectional view of interlocking blocks according to invention.

Figure 13:
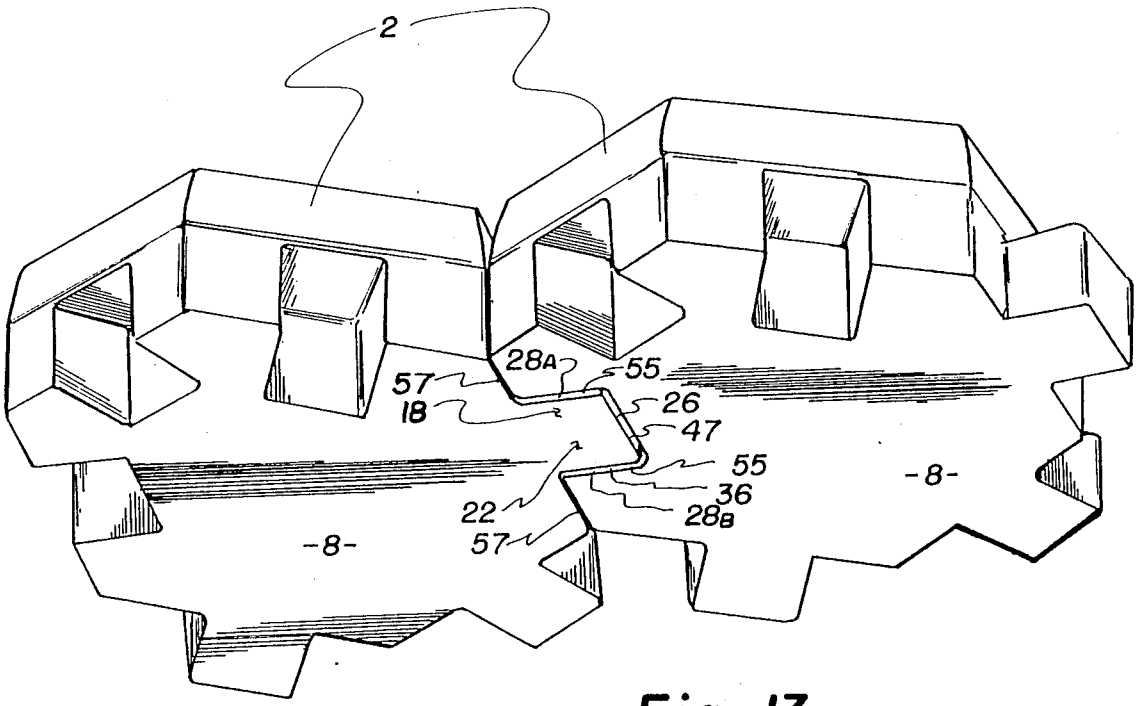

FIG. 13 is a bottom perspective view of interlocking blocks according to the present invention.

Figure 14:
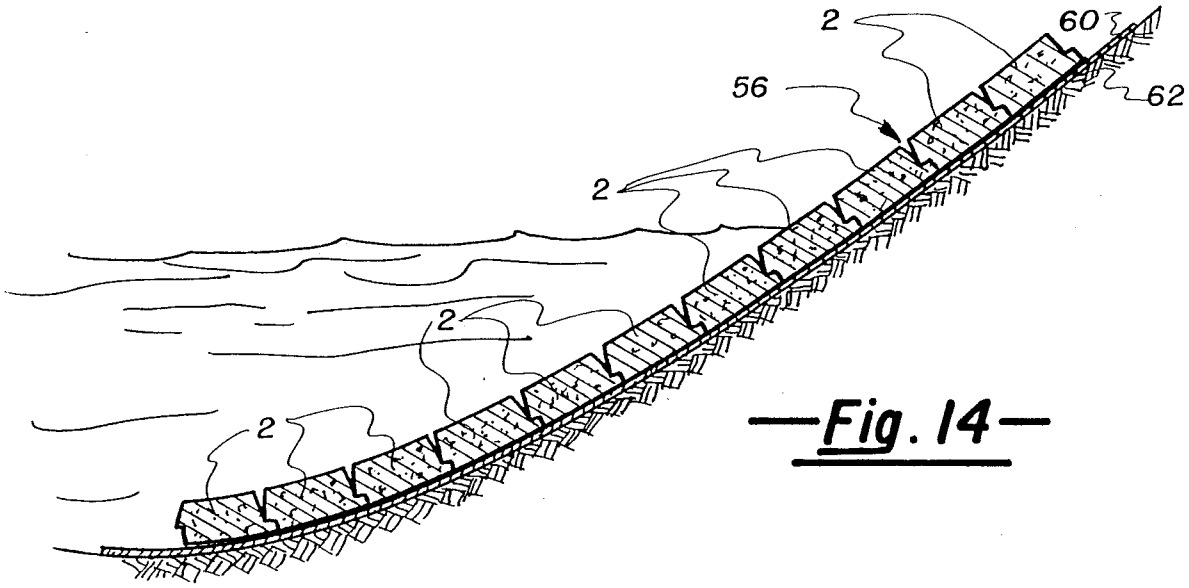

FIG. 14 is a cross-sectional view if a revetment positioned along a shoreline.

DESCRIPTION OF THE PREFERRED EMBODIMENT

The preferred embodiment of the invention is now described with reference to the drawings, in which like numbers represent like parts throughout the views.

Figure 1:
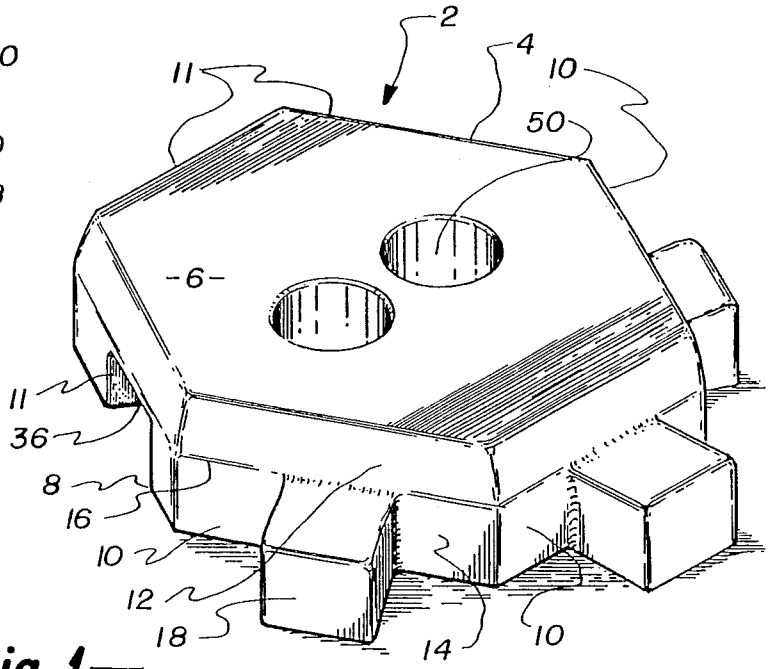
FIG. 1 is a top perspective view of a block according to the present invention.
Figure 2:
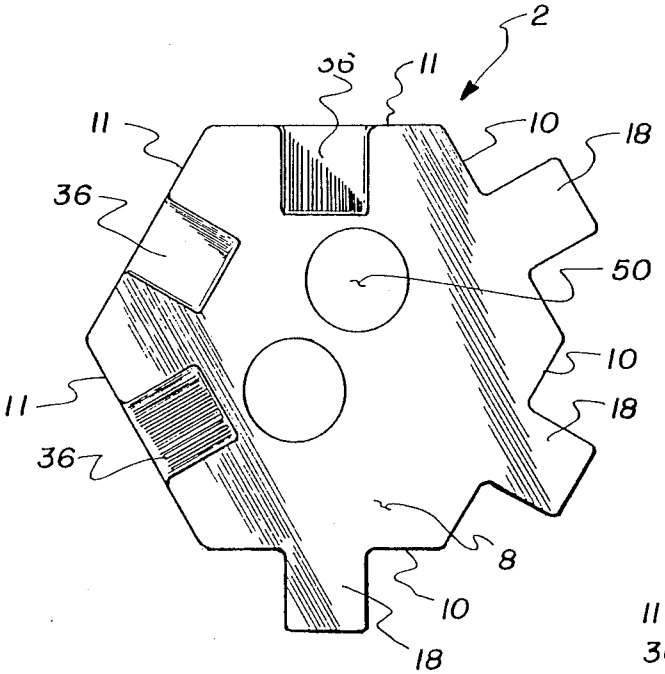
FIG. 2 is a bottom view of a block according to the present invention.

FIGS. 1 and 2 show a block 2, preferably made of concrete, used in the present invention. Each block 2 is comprised of a polygonal, and preferably hexagonal, grid member 4 and connecting means. The grid 4 has a top surface 6, a bottom a bottom surface 8, and six side surfaces 10 and 11, the side surfaces being either tongue side surfaces 10 or cavity side surfaces 11. The polygonal shape enables the block to resist hydrostatic forces in all directions, as discussed more fully below. Each grid 4 may also have a plurality of holes 50 extending from the top surface 6, through the grid 4 to the bottom surface 8. The holes 50 reduce hydrostatic pressure and permit vegetation to grow through the grid 4. These holes 50 may be square or circular in shape, the circular type being easier to produce. In addition, the diameter or number of the holes may be varied to account for weather conditions. For example, in colder regions, where a more solid block 2 is required, one may decrease the number of holes 50 or decrease the diameter of each hole 50, and thereby increase the strength of the block 2. Also, a solid block 2 may be used in extremely harsh environments. This will reduce the risk of the impact damage commonly caused by ice flows solid blocks 2 are also useful in areas where the subsoil is clay.

Referring to FIG. 1, a tongue side surface 10 has an upper side surface 12 and a lower side surface 14. The upper side surface 12 extends upward from a horizontal line 16 approximately midway vertically between the bottom surface 8 and the top surface 6 of the grid 4, to the top surface 6. The upper side surface 12 slopes inwardly from the vertical midway line 16 to the top surface 6. The lower side surface 14 extends from the midway line 16 to the bottom surface 8 of the grid 4 and is more vertical than the upper side surface 12.

Figure 3:
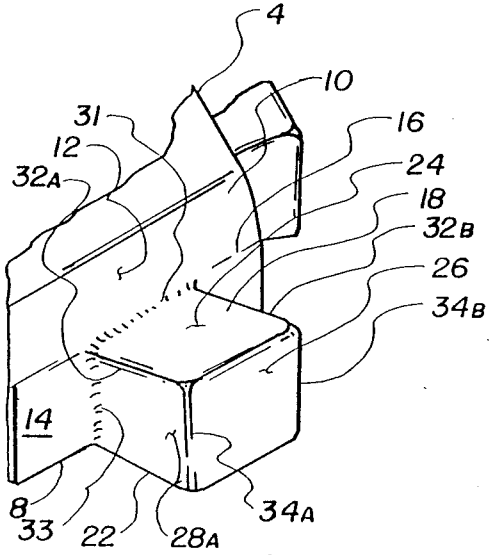
FIG. 3 is a perspective view of a tongued-wall portion of a block according to the present invention.

Located on the lower side surface 14 of each tongue side surface, is a connecting tongue 18, shown in detail in FIG. 3. The tongue 18 is centered on the face 14 of the tongue side surface 10 and extends vertically from the bottom surface 8 of the grid 4 to approximately the vertical midway line 16. The tongue 18 has five exposed surfaces; a flat bottom tongue surface 22, a top tongue surface 24, a front tongue surface 26, and a pair of parallel side tongue surfaces 28 a and b. The top tongue surface 24 slopes downwardly from the front tongue surface 26 to the lower side surface 14 of the grid 4. The front tongue surface 26 slopes inwardly toward the top tongue surface 24. A first tongue edge 30 connecting the top tongue surface 24 and the front tongue surface 2 is rounded, as are a pair of second tongue edges 32 a and b connecting the top tongue surface 24 and each of the side tongue surfaces 28 a and b. A pair of third tongue edges 34 a and b connecting the front tongue surface 26 and the side tongue surfaces 28 a and b are similarly rounded. The line of connection 31 between the top tongue surface 24 and the block upper side surface 12 is the nature of an annular fillet. Furthermore, the connecting edge 32 where the top tongue surface 24 and the side tongue surfaces 28 a, b meet the grid are in the nature of an annular fillet. Also, each corner 33 where block side surfaces 14 meet tongue side surfaces 28 a, b is rounded, as is the connection along vertical midway line 16 between lower side surfaces and upper side surfaces. The rounded tongue edges 30, 32 and 34, connection 31 and corners 33 enhance movement of the tongue 18 within the cavity 36 and the dissipation of stress in an assembled mat, as discussed more fully below.

Figure 4:
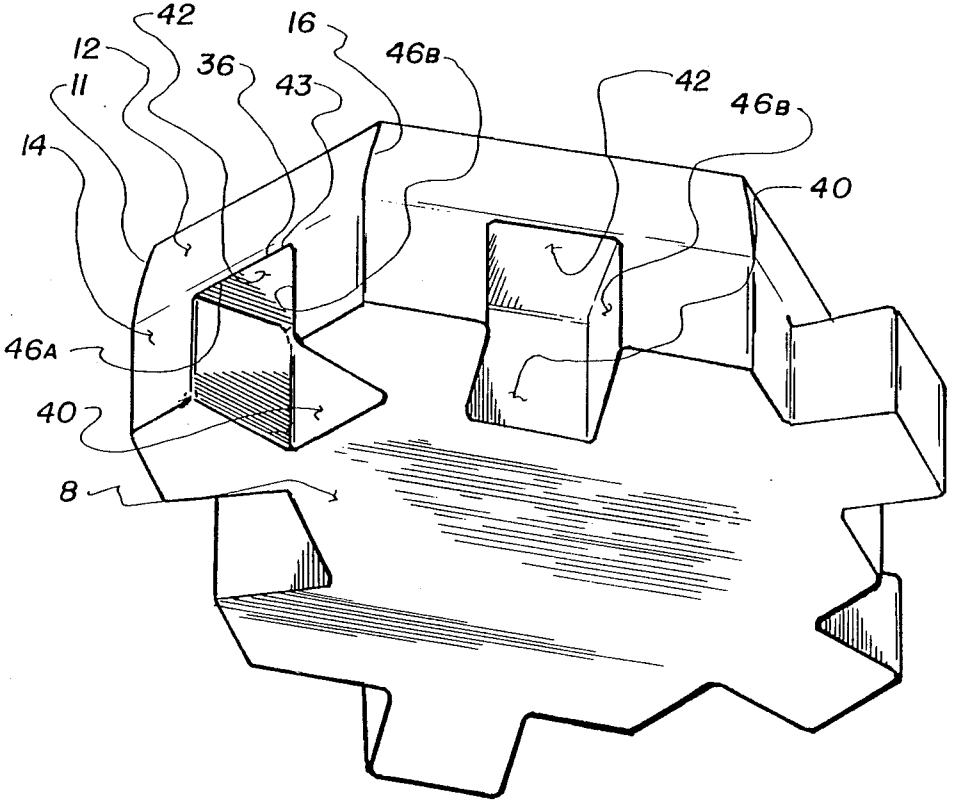
FIG. 4 is a bottom perspective view of a block according to the present invention.

FIG. 4 shows cavity side surfaces 11 of a grid 4. The side surface 11 has an upper side surface 12 and a lower side surface 14 similar to that shown in FIG. 1, but contains a tongue receiving cavity 36 instead of a connecting tongue 18. The cavity 36, like the connecting tongue 18, is located at the center of the lower side surface 14 of the cavity side surface 11 and extends vertically from the bottom surface 8 of the grid 4 to approximately the vertical midway point 16. The cavity 36 has a cavity opening, a backwall 40, an upperwall 42, and a pair of parallel sidewalls 46*a* and *b*.

The cavity 36 is of sufficient size to allow full entry of the tongue 18 inside it, with additional room to allow slight movement of the tongue 18 once inside. The width and height of the cavity 36 is of sufficient size to allow entry of the front tongue surface 26 through it, as seen in FIG. 13. Likewise, the height of the cavity sidewalls 46*a* and *b* are of sufficient size to allow entry of the full side tongue surfaces 28*a* and *b*. A rounded upper cavity edge 43 is located between the upper side surface 12 and the upperwall 42 of the cavity 36. Preferably, the sidewalls 46*a* and *b* are downwardly sloping away from the upper wall 42, so that the cavity 36 forms a reverse image of the tongue.

Figure 6:
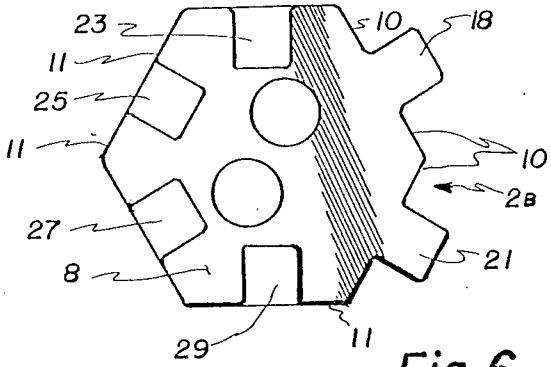
FIG. 6 is a bottom view of an inner edge block according to the present invention.
Figure 5:
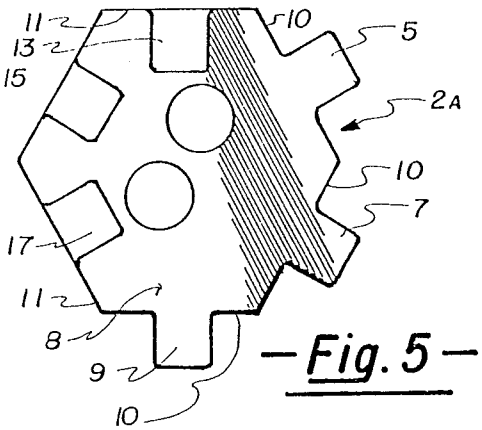
FIG. 5 is a bottom view of an interior block according to the present invention.

FIGS. 5, 6 and 7 show types of blocks 2, used in the present invention; each type differing in the number of tongues 18 and cavities 36, but otherwise as described above.

FIG. 5 shows an interior block 2*a* having three adjacent tongue side surfaces 10 containing a first interior block tongue 5, a second interior block tongue 7 and a third interior block tongue 9; and three adjacent cavity side surfaces 11, containing a first interior block cavity 13, a second interior block cavity 15, and a third interior block cavity 17.

FIG. 6 shows an inner edge block 2*b* having a pair of adjacent tongue side surfaces 10, containing a first inner edge tongue 19 and a second inner edge block tongue 21; and four adjacent cavity side surfaces 11; containing a first inner edge block cavity 23, a second inner edge block cavity 25, a third inner edge block cavity 27, and a fourth inner edge block cavity 29.

FIG. 7 shows an outer edge block 2*c* having four adjacent tongue side surfaces 10 containing a first outer edge block tongue 31, a second outer edge block tongue 33, a third outer edge block tongue 35 and a fourth outer edge block tongue 37; and a pair of adjacent cavity side surfaces 11, containing a first outer edge block cavity 39 and a second outer edge block cavity 41.

To form a revetment mat, a number of blocks 2 are coupled together. FIG. 8 shows, in detail, a bottom perspective of a cluster of coupled blocks 2. The center block 80 is held in position, both horizontally and vertically, by the weight of the blocks 81–86 surrounding and coupled with the block 80. That is, the block 80 is held in stable horizontal position by the surrounding blocks 81–86, and cannot be moved out of its vertical coupled position because of the downward force of the surrounding blocks 2 on the tongues 18 of the block 80. Furthermore, each surrounding block 81 through 86 is likewise surrounded by other blocks 2, unless it is along an edge of a mat, in which case it is only partially surrounded. However, even the partially surrounded blocks 2 are held in position with the aid of the tongue 18 and cavity 36 coupling means. For extra stability, revetment ends and bottoms can also be buried in the subsoil and covered with stone. Also, anchoring means may be used to provide added stability to mats placed on slopes.

FIG. 9 shows an exploded view of one embodiment of a revetment mat constructed from the above-described blocks 2. To form the mat 56 a plurality of blocks 2 are interconnected by inserting the tongues of blocks 2 into the cavities of neighboring blocks 2. The mat 56, when completed, has an inner edge 58, an interior portion 60, an outer edge 62, an upper line 65 of cavities, and a lower line 61 of tongues, a first side line 67 of cavities, and a second side line 69 of tongues. The inner edge 58 is comprised of a plurality of inner edge blocks 2*b*, as shown in FIG. 6, connected to form a row of desired length. The row is formed when the first inner edge block tongue 19 of a first inner edge block 52 is coupled with the third inner edge block cavity 27 of a second inner edge block 53, and the first inner edge block tongue 19 of the second inner edge block 53 is coupled with the third inner edge block cavity 27 of a third inner edge block 55. Additional similar inner edge blocks 2*b* are present in the row so as to achieve a mat 56 of desired length. This results in each inner edge block 2*b* of the edge 58 having its first inner edge block cavity 23 and its second inner edge block cavity 25 adjacent to each other and opposite the interior portion 60 of the mat, and the second inner edge block tongue 21 and the fourth inner edge block cavity 29 facing the interior portion 60 of the mat 56.

A first interior block 48 is coupled with the inner edge 58 having coupled the first interior block tongue 5 of the interior block 48 to the fourth inner edge block cavity 29 of the second inner edge block 53, and the second inner edge block tongue 21 to the first interior block cavity 13 of the first interior block 48. A second interior block 49 is connected to the edge 58 by similarly being coupled with the second and third inner edge blocks 53 and 55 and further by having coupled the second interior block tongue 7 of the first interior block 48 to the second interior block cavity 15 of the second interior block 49. Further interior blocks 2*a* are connected to the inner edge blocks 2*b* in similar manner as desired. Interior blocks 2*a* may also be coupled with other interior blocks 2*a* to form the remainder of the interior portion 60 of the mat. The first interior block tongues 5 of interior blocks 2*a* are coupled with the third interior block cavities 17 of adjacent interior blocks 2*a* so as to form a mat of interconnecting blocks of desired surface area. Likewise, the second interior block tongue 7 of each interior block 2*a* is coupled with the second interior block cavity 15 of a neighboring interior block 2*a*.

The blocks forming the outer edge 62 of the mat 56 are attached to those forming the interior portion 60. Outer edge blocks 2*c* are connected to interior blocks 2*a* by coupling the first outer edge block tongue 31 of the first outer edge block 57 to the third interior block cavity 17 of the first interior block 48. The first outer edge block cavity 39 of the second outer edge block 59 is coupled with a third internal block tongue 9 of block 48. The second outer edge block tongue 33 of the first outer edge block 57 of the outer edge 62 is coupled with the second outer edge block cavity 41 of the next succeeding outer edge block 59. Additional outer edge blocks 2*c* are similarly present to form the outer edge 62.

Each block 2 may optionally be provided with a through tunnel 70 which begins on the front tongue surface 26, passes through the grid 4, and exits on the backwall 40 of a tongue receiving cavity 36 directly opposite the tunneled tongue surface 26. As shown in FIG. 9, for the first interior block 48 which is an inner edge block 2*b*, the tunnel 70 begins on the second interior block tongue 7 and exits on the backwall 40 of the second interior block cavity 15. On the inner edge block 52, which is an interior block 2*a*, the tunnel 70 begins on the first inner edge block tongue 19 and exits on the backwall 40 of the third inner edge block cavity 27. On the first outer edge block 57, which is an outer edge block 2*c*, the tunnel 70 begins on the second outer edge block tongue 33 and exits on the second outer edge block cavity 41. In each block 2, the tunnel 70 is located at a uniform location on both the front tongue surface 26 and the backwall 40 so as to allow the tunnel 70 of a first block 2 to align with the tunnel 70 of a second, interconnected block 2. Additionally, the uniformity of tunnel 70 location allows grids 4 of varying height and weight, as shown in FIG. 11, to be interconnected as desired.

Cables, or rods, preferably plastic, stainless steel, or other non-corrosive material, may be inserted through the tunnels 70 to provide additional stability to mats 56. The cable 45 has minimal exposure to sunlight or the elements because the point where it leaves one block 2 and enters a second block 2 is within a cavity 15.

FIG. 10 illustrates an assembled mat 56, either preassembled or assembled on-site. When assembly is done on-site, a base block 101 is set at a desired position. Preferably, the base block 101 is set at the point corresponding to offshore limit of the revetment and the revetment is assembled by working towards the shoreline. A second block 102 is positioned a distance equivalent to a block 2 width laterally away from the base block 101. A third block 103 is then coupled with base block 101 and block 102 as shown. A fourth block 104 is similarly set a block 2 width laterally away from block 102, and a fifth block 105 is coupled with block 102 and block 104. This procedure is repeated laterally, until a mat edge of desired length is achieved. Thereafter, another row of blocks is formed by coupling a block 100 to blocks 101 and 103, as shown. Block 109 is coupled to blocks 102, 103 and 105. Block 110 is then coupled to blocks 104, and 105. This procedure is also repeated laterally to form additional rows of blocks 2. By following this sequence, the blocks 2 can be maneuvered to allow easy insertion of tongue into cavities as an entire mat 56 is assembled.

Once assembled either on-site or off-site, cables not shown, preferably of plastic or other non-corrodable material, may be passed through the tunnels 70, shown in FIG. 9, of the interconnected blocks 2 to provide stability beyond the tongue 18 and cavity 36 connecting means. The cable 45 has minimal exposure to sunlight and the elements because the points where the cable 45 leaves one block 2 and enters a second block 2 is within a cavity 15. The mat 56 may also be lifted with parallel cables passed through the tunnels 70. This will provide a good catenary curve to the mat 56 during lifting, and encourages cavities 36 to fall clearly over tongues 18 of adjacent mats 56 during assembly.

Optionally, as illustrated in FIG. 10, second holes 43 may be provided through the grids 4 at points above the tongues 18 and cavities 36 of the block 2. These second holes 43 are placed so that a cable 45 or rod may be placed in a second, diagonal position through the assembled blocks 2, and, either alone or in combination with through tunnel 70, shown in FIG. 9, provide added stability to the mat 56. The mat 56 can be therefore optionally assembled block by block at the point of use, or can be pre-assembled and positioned as a unit. When pre-assembly is desired, the cables 45 at the ends of the assembled mat can be hooked to a doublebar strongback so as to allow the mat 56 to be lifted by a crane and placed in final position. The use of cables 45 to connect the blocks 2 provides sufficient stability during lifting. The hexagonal shapes of the grids 4 results in a mat 56 of good catenary curve when lifted, and encourages cavities 36 to fall cleanly over tongues 18 of adjacent mats 56.

Because of the stability provided by the interlocking tongue and groove connections, mats may be formed using no cables or a minimal number of cables 45. For example, a mat may be reinforced with a plurality of loops. The parallel placing of the loops as they enter the preassembled mat enables the mat to be lifted uniformly and without distortions. This will prevent excess strain on the interlocking blocks. Also, for maximum stability, the points at which the cables are lifted should be on the same axis as the point where the cables enter the block 2.

The size of the revetment may be increased by joining preassembled mats 56 together, as shown in FIG. 10. The width of the revetment may be increased by attaching the upper edge 65 of an already positioned first mat **56*a* to the lower edge 61 of a second, preassembled mat 56*b*. Similarly, the length of the revetment may be increased by attaching the first side line 67 of a mat 56*b* to the second side line 69 of tongues of an already positioned mat 56*b*. Additional preassembled mats 56 can be further added to cover the surface area as necessary. For additional strength, the mats 56** may be connected in a staggered manner.

Figure 6A:
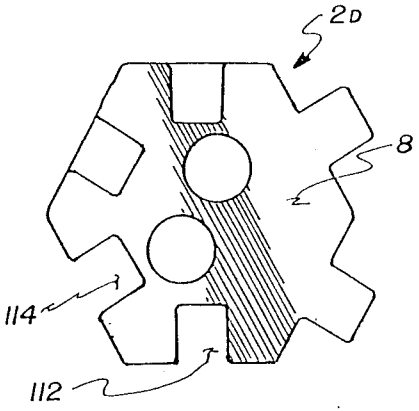

An end block may be used either at the end of an assembled revetment, so as to reduce the total surface area of the block and thereby minimize hydrostatic pressure, or an inner edge block when lateral cables are used to connect serially connected mats. The end block is hexagonal-shape and has a pair of tongue side surfaces separated by a single cavity side surface. The remaining three adjacent sides are also cavity side surfaces. A through tunnel may extend through the block beginning at the single cavity side surface between the two tongue side surfaces, and ending at the surface opposite the single cavity side surface. In this way, cables may optionally be placed laterally through the mat for further stability. Mats having edges formed by end blocks can be tied together by swaging plastic, and the splices may be grouted in the cavities to avoid vandalism and provide tight connections. Also, an opened block **2*d*, as seen in FIG. 6*a*, may be provided. The opened block 2*d* is used similarly to inner edge block 2*b*, but has a pair of opened, adjacent grooves 112 and 114 for allowing easier connecting of mats 56 having knotted cable lines along their edges. The grooves 112 and 114** also make grouting of the connections an easier task.

If the mat 56 is to be assembled on site, the outer edge blocks **2*c* and the inner edge blocks 2*b* may be omitted and only the interior blocks 2*a* used. Also, unless there is a need for enhanced stability, the cables 45 may be omitted and the tongue 18 and cavity 36 connecting means relied on to hold the mat 56 together. Other than the optional cables 45, no auxiliary components are needed to hold the mat 56** together. This results in increased effectiveness in both time and cost.

FIG. 12 shows a cross-sectional view of three coupled blocks 2. A tongue 18 is inserted into a cavity 36, thereby interlocking two blocks. A first space 47 is formed between the sloped front tongue surface 26 and the vertical backwall 40. A second space 49 is formed between the sloped top tongue surface 24 and the adjacent horizontal ceiling 42 of the cavity 36. A third space 51 is formed between the sloped upper side surface **12*a* of the first block 2 and the sloped upper side surface 12*b* of the second block 2. As shown in FIG. 13, which is an underneath perspective view of a tongue 18 within a cavity 15, the width of the tongue 18 is less than the width of the cavity 36, so that a fourth space 55 is formed between the side tongue surfaces 28*a* and *b* and the sidewalls 46*a* and *b* of the cavity 36. The spaces 47, 49 and 55 allow the tongue 18 to move slightly within the cavity 36 while remaining coupled both vertically and horizontally by the presence of the grid 4 around the cavity 36. The space 51 allows one block 2*a* to pivot slightly at its midpoint 16 in relation to its neighboring block 26. These slight movements prevent any one tongue 18 from taking the entire destructive force during water impact. This is especially important when the blocks 2** are made of concrete, which is low in tensile strength.

The slight movement of the blocks 2 within the mat 56 also creates space 57 between lower side surfaces 14 of adjacent blocks 2. This space 57, as well as the holes 50 of the grid 4, provide relief from hydrostatic pressure when the mat 56 is subject to force, for example, during high and low frequency wave attack. The holes 50 and spaces in the mat 56 also reduce downstream water velocities due to eddy currents and provide a means of easy draw-down of adjacent high water tables after storms. An advantage gained is that the increase in resistance decreases the length of revetment needed. The rounded tongue edges 30, 32, **34*a* and *b*, enhance the movement between blocks 2. The flexibility also permits the mat 56** to adjust to the topographic features of the riverbank or beach.

Referring again to FIG. 13, bottom surface 8 of the grid 4 and bottom tongue surfaces 22 form one continuous flat surface. This results in the mat 56 having a flat bottom surface which, in conjunction with the flexibility of the mat 56 described above, results in minimizing space between the bottom surface and the subsoil. This reduces hydraulic lifting of the blocks 2. Also, if any hydraulic lift does occur, the blocks 2 cannot become dislodged vertically or horizontally due to the mating of the tongues 18 of each block with the cavities of adjacent blocks 36.

FIGS. 11 and 14, show typical shoreline profiles of mats 56. The mat 56 may be placed either directly on the subsoil 62, on a filter fabric 60 to discourage erosion of subsoil, or on other filter means. As stated above, blocks 2 of varying thickness may be utilized by providing tunnels 70, shown in Fig. 9, or holes 43, shown in FIG. 10, on equal planes throughout the blocks 2, and by providing identically sized tongues 18 and cavities 36. Preferably, blocks 2 of varying heights and weights are alteringly positioned in deeper water to provide higher coefficient of roughness to the mat surface to slow the flow of water over the mat towards the shore line, as shown in FIG. 14. This increases the ability of the mat to withstand wave attack by dissipating kinetic energy before the wave attack reaches the main line revetment.

While the above description contains many specifications these should not be construed as limitations on the scope of the invention, but rather as an amplification of one preferred embodiments thereof. For example; the size of blocks can vary depending upon application.

What is claimed is:

1. A revetment block for being coupled with other similar blocks to form a flexible revetment mat for controlling erosion of soil, comprising:

a grid having a top surface, a bottom surface, and a plurality of side surfaces, each said side surface comprising an upper side surface and a lower side surface which form a common continuous edge between the top surface and the bottom surface of said grid, wherein said upper side surface slopes inwardly from the common edge to the top surface of said grid, and said lower side surface is more vertical than said upper side surface and wherein a tongue extends from at least one of said side surfaces, each tongue having a height and width less than the total height and width of said grid, and wherein each of said side surfaces which has no tongue has a tongue receiving cavity surrounded by a pair of cavity sidewalls, a cavity backwall and a cavity upperwall, said cavity being of a size sufficient to receive and allow limited vertical and horizontal movement of tongues from other blocks within said cavity.

2. The revetment block of claim 1, wherein said grid has six side surfaces.

3. The revetment block of claim 2, wherein a tongue is located on each of three adjacent said side surfaces, and a tongue receiving cavity is located in each of three side surfaces not having a tongue.

4. The revetment block of claim 1, wherein each of said tongues is comprised of a bottom tongue surface coplanar with said bottom surface of said grid, a top tongue surface opposite said bottom tongue surface, a front tongue surface connecting said top tongue surface and said bottom tongue surface and a pair of side tongue surfaces, said front tongue surface sloping inwardly toward said grid and said top tongue surface sloping downwardly from said front tongue surface to said lower side surface of said grid.

5. The revetment block of claim 4, further comprising a first rounded edge connecting said top tongue surface and said front tongue surface, a pair of second rounded edges connecting said top tongue surface and each of said side tongue surfaces, and a pair of third rounded edges connecting said front tongue surface and each of said side tongue surfaces, said rounded edges enhancing movement of said tongue within said cavity.

6. The revetment block of claim 1, wherein said tongue receiving cavity comprises a pair of downwardly sloping cavity sidewalls, a cavity upperwall connected to said cavity sidewalls, and a cavity backwall substantially parallel to said lower surface side of said grid and connected to said cavity sidewalls and said cavity upperwall.

7. The revetment block of claim 1, wherein said grid has a hole extending vertically from said top surface of said grid through the grid to said bottom surface of said grid.

8. The revetment block in claim 1, wherein said block is made of concrete.

9. The revetment block of claim 1, wherein said block has a first through tunnel beginning at said front tongue surface, extending through said block, and ending at a cavity opposite said front tongue surface through which a cable may be provided for adding stability to said mat.

10. The revetment block of claim 9, wherein said block has an upper through tunnel extending horizontally through said upper side surface of said grid through which a cable may be provided.

11. The revetment block of claim 1, wherein said block has an upper through tunnel extending horizontally through said upper side surface of said grid through which a cable may be provided.

12. A flexible revetment mat used for controlling the erosion of soil comprising a plurality of coupled blocks, wherein each of said blocks comprises:

a grid having a top surface, a bottom surface, and a plurality of side surfaces, each said side surface comprising an upper side surface and a lower side surface which form a common continuous edge between the top surface and the bottom surface of said grid, wherein said upper side surface slopes inwardly from the common edge to the top surface of said grid, and said lower side surface is more vertical than said upper side surface and wherein a tongue extends from a least one of said side surfaces, each tongue having a height and width less than the total height and width of said grid, and wherein each of said side surfaces which has no tongue has a tongue receiving cavity of a size sufficient to receive and allow limited movement of tongues from other blocks within said cavity.

13. The flexible revetment mat of claim 12, wherein each of said tongues is comprised of a bottom tongue surface coplanar with said bottom surface of said grid, a top side tongue surface opposite said bottom tongue surfaces, a front tongue surface connecting said top tongue surface and said bottom tongue surface and a pair of parallel side tongue surfaces, said front tongue surface sloping inwardly toward said grid and said top tongue surface sloping downwardly from said front tongue surface to said lower side surface of said grid.

14. The flexible revetment mat of claim 13, wherein each said block further comprises a first rounded edge connecting said top tongue surface and said front tongue surface, a pair of second rounded edges connecting said top tongue surface and each of said side tongue surfaces, and a pair of third rounded edges connecting said front tongue surface and each of said side tongue surfaces, said rounded edges enhancing movement of said tongue within said cavity.

15. The flexible revetment mat of claim 12, wherein each of said tongue receiving cavities comprises a pair of parallel cavity sidewalls, a cavity upperwall connected to said cavity sidewalls, and a cavity backwall parallel to said lower surface side of said grid and connected to said cavity sidewalls and said cavity upperwall.

16. The flexible revetment mat of claim 12, wherein at least one of said blocks has a hole extending vertically from said top surface of said grid, through said grid, to said bottom surface of said grid.

17. The flexible revetment mat of claim 12, wherein each of said blocks are made of concrete.

18. The flexible revetment mat of claim 12, wherein each said block has a cable-through tunnel having a first opening on a front surface of a tongue of one side of said block and a second opening on a cavity backwall of a cavity opposite said tongue, said tunnel extending horizontally through said block from said first opening to said second opening.

19. The flexible revetment mat of claim 18, wherein each row of blocks is interconnected to an adjacent row by a rod passed through said through-tunnels of said blocks.

20. The flexible revetment mat of claim 19, wherein said rod is plastic.

21. The flexible revetment mat of claim 18, wherein each row of blocks is interconnected to an adjacent row by a cable passed through said through tunnels in said blocks.

22. The flexible revetment mat of claim 21, wherein said cable is plastic.

23. The flexible revetment mat of claim 21, wherein each through-tunnel is lined with a plastic sleeve for enhancing the ease with which a connecting cable can be passed through said through-tunnel.

24. The flexible revetment mat of claim 12, wherein said mat has an interior portion comprised of rows of coupled interior type blocks, each interior type block comprising a tongue on each of three adjacent said lower said surfaces, and a tongue-receiving cavity on each of the three lower side surfaces not having a tongue.

25. The flexible revetment mat of claim 12, comprising a first mat edge having a tongue-receiving cavity on each of said lower side-surface of blocks forming said first mat edge; and a second mat edge opposite said first edge having a tongue on each said lower side-surface of blocks forming said second mat edge, such that a first mat edge of one of said mats may be coupled to a second edge of a like mat by coupling said tongues of one mat into said cavities of said like mat to allow formation of a continuous series of said mats.

26. The revetment mat of claim 25, wherein a third mat edge having a tongue-receiving cavity on each said side surfaces of blocks forming said third mat edge, and a fourth mat edge opposite said third edge having a tongue on each said side surface of blocks forming said fourth edge, such that a third mat edge of one of said mats may be coupled to a fourth edge of a like mat by coupling said tongues of one mat into said cavities of said like mat to allow formation of continuous series of said mats.

27. The flexible revetment mat of claim 26, wherein said first mat edge is formed from a row of coupled inner edge blocks coupled to one side of said interior mat portion, each of said inner edge blocks having a tongue on each of two adjacent lower side surfaces, and a tongue-receiving cavity on each of four lower side surfaces not having a tongue.

28. The flexible revetment mat of claim 27, wherein said second mat edge is comprised of a row of outer edge blocks coupled to a side of said interior mat portion opposite said inner edge, each of said outer edge blocks having a tongue on each of four adjacent said lower side surfaces, and a tongue-receiving cavity on each of two said lower side-surfaces not having a tongue.

29. The revetment mat of claim 12, wherein said grid has six sides.

30. The revetment mat of claim 12, wherein said blocks are of varying heights to create a high coefficient of roughness along said mat to show the flow of water over said mat.

31. A revetment block for being coupled with other similar blocks to form a flexible revetment mat for controlling erosion of soil, comprising:

a grid having a top surface, a bottom surface, and a plurality of side surfaces, each said side surface comprising an upper side surface and a lower side surface which form a common continuous edge between the top surface and the bottom surface of said grid, wherein said upper side surface slopes inwardly from the common edge to the top surface of said grid, and said lower side surface is more vertical than said upper side surface and wherein a tongue extends from at least one of said side surfaces, each tongue having a height and width less than the total height and width of said grid, and wherein each of said side surfaces which has no tongue has a tongue receiving cavity of a size sufficient to receive and allow limited movement of tongues from other blocks within said cavity, said tongue having a bottom tongue surface coplanar with said bottom surface of said grid, a top tongue surface opposite said bottom tongue surface, a front tongue surface connecting said top tongue surface and said bottom tongue surface and a pair of side tongue surfaces, said front tongue surface sloping inwardly toward said grid and said top tongue surface sloping downwardly from said front tongue surface to said lower side surface of said grid, a first rounded edge connecting said top tongue surface and said front tongue surface, and a pair of second rounded edges connecting said top tongue surface and each of said side tongue surfaces, said rounded edges enhancing movement of said tongue within said cavity.

32. The revetment block of claim 31, and further comprising a pair of third rounded edges connecting said front tongue surface and each of said side tongue surfaces.

33. A flexible revetment mat used for controlling the erosion of soil comprising a plurality of coupled blocks, wherein each of said blocks comprises:

a grid having a top surface, a bottom surface, and a plurality of side surfaces, each said side surface comprising an upper side surface and a lower side surface which form a common continuous edge between the top surface and the bottom surface of said grid, wherein said upper side surface slopes inwardly from the common edge to the top surface of said grid, and said lower side surface is more vertical than said side surface and wherein a tongue extends from at least one of said side surfaces, each tongue having a height and width less than the total height and width of said grid, and wherein each of said side surfaces which has no tongue has a tongue receiving cavity of a size sufficient to receive and allow limited movement of tongues from other blocks within said cavity, said tongue having a bottom tongue surface coplanar with said bottom surface of said grid, a top tongue surface opposite said bottom tongue surface, a front tongue surface connecting said top tongue surface and said bottom tongue surface and a pair of side tongue surfaces, and front tongue surface sloping inwardly toward said grid and said top tongue surface sloping downwardly from said front tongue surface to said lower side surface of said grid, a first rounded edge connecting said top tongue surface and said front tongue surface, and a pair of second rounded edges connected said top tongue surface and each of said side tongue surfaces, said rounded edges enhancing movement of said tongue within said cavity.

34. The revetment mat of claim 33, wherein said block further comprises a pair of third rounded edges connecting said front tongue surface and each of said side tongue surfaces.

35. A revetment block for being coupled with other similar blocks to form a flexible revetment mat for controlling erosion of soil, comprising:

a grid having a top surface, a bottom surface, and six side surfaces, each said side surface comprising an upper side surface and a lower side surface which form a common continuous edge between the top surface and the bottom surface of said grid, wherein said upper side surface slopes inwardly from the common edge to the top surface of said grid, and said lower side surface is more vertical than said upper side surface and wherein a tongue extends from each of three adjacent said side surfaces, each tongue having a height and width less than the total height and width of said grid, and wherein each of said side surfaces which has no tongue has a receiving cavity having a top wall and sidewalls, said cavity being of a size sufficient to receive and allow limited vertical and horizontal movement of tongues from other blocks within said cavity.

36. A flexible revetment mat used for controlling the erosion of soil comprising a plurality of coupled blocks, wherein each of said blocks comprises:

a grid having a top surface, a bottom surface, and six side surfaces, each said side surface comprising an upper side surface and a lower side surface which form a common continuous edge between the top surface and the bottom surface of said grid, wherein said upper side surface slopes inwardly from the common edge to the top surface of said grid, and said lower side surface is more vertical than said upper side surface and wherein a tongue extends from each of three adjacent said side surfaces, each tongue having a height and width less than the total height and width of said grid, and wherein each of said side surfaces which has no tongue has a receiving cavity being of a size sufficient to receive and allow limited vertical and horizontal movement of tongues from other blocks within said cavity.

* * * * *